United States Patent [19]

Foster

[11] Patent Number: 4,775,140

[45] Date of Patent: Oct. 4, 1988

[54] ENVELOPE SUPPLY PACK RETAINER

[75] Inventor: Dean H. Foster, Stratford, Conn.

[73] Assignee: Pitney Bowes Inc., Stamford, Conn.

[21] Appl. No.: 112,323

[22] Filed: Oct. 26, 1987

[51] Int. Cl.[4] ..... B65H 3/52

[52] U.S. Cl. ..... 271/121; 271/149; 271/274

[58] Field of Search ..... 271/121, 125, 122, 273, 271/274, 149, 167

[56] References Cited

U.S. PATENT DOCUMENTS

| | | | |
|---|---|---|---|
| 1,085,781 | 2/1914 | Allen | 271/10 |
| 2,762,623 | 9/1956 | Uthanwoldt et al. | 271/36 |
| 3,162,435 | 9/1962 | Rastorguyeff et al. | 271/2 |
| 4,034,976 | 7/1977 | Lundblad | 271/122 X |
| 4,039,180 | 8/1977 | Stocker | 271/10 |
| 4,501,417 | 2/1985 | Foster et al. | 271/124 |
| 4,674,736 | 6/1987 | Tsubo | 271/122 |

*Primary Examiner*—Richard A. Schacher

*Attorney, Agent, or Firm*—Lawrence E. Sklar; David E. Pitchenik; Melvin J. Scolnick

[57] ABSTRACT

An envelope and document feeder is disclosed within which there is a first stationary frame, and a second movable frame. The feeder has a support surface for a stack of articles to be fed seriatim, and has an apparatus which is engaged by the second movable frame to permit feeding. When the second frame is pivotably raised, the engaging apparatus prevents the articles from sliding down into the throat of the feeder.

5 Claims, 9 Drawing Sheets

40
18
76
54
94
96
96a
90
96b
52
64
66
58
7
56
76'
48
46
44
40'
50
7

ENVELOPE SUPPLY PACK RETAINER

BACKGROUND OF THE INVENTION

The present invention relates to an envelope and document feeder for an inserting machine. It is primarily directed to an envelope feeder; however, it will be recognized that the present invention has utility in feeders for other kinds of documents and materials.

Envelope feeders are very well known for their capability and use within inserting machines. These feeders are rigidly mounted structures which are typically arranged at a downstream location of the inserting machine, adjacent to the mailing machine portion of the inserting machine. These prior art feeders are designed to receive and hold a stack of envelopes on an inclined surface which leads to a feed path and a stuffing or inserting station. The problem with these early feeders has been that it is difficult to clear jams and to otherwise gain ready access to the feed path associated with the entrance to the inserting machine.

The present invention overcomes the obstacle of lack of accessibility while also providing a solution to retaining a stack of envelopes from sliding down into the feed path when the feeder is being opened and cleared of jams or misfed envelopes.

BRIEF SUMMARY OF THE INVENTION

The present invention is embodied in an inserting machine which feeds documents and envelopes. The envelopes are fed to an inserting station, where documents may be stuffed into the envelopes.

The feeder includes a first stationary frame which is fixed to the inserting machine. There is a second frame pivotably mounted on the first frame for movement between a closed, operating position and an open position where operator access to the envelopes is provided. There is an inclined surface mounted on the first frame for supporting a stack of envelopes in a substantially upright position. The envelopes are fed seriatim from the lower end of the stack as they slide down the inclined surface under the influence of gravity. There is a separator device mounted on the first and second frame for cyclically feeding the envelopes from the lower end of the stack. The separator device is located in an upstream position with respect to a feed path for the envelopes which is normally defined between the frames while the frames are in the closed, operating position. A feeding apparatus is mounted along the feed path for conveying the envelopes. The feeding apparatus is separable and exposed when the frames are moved to the open position. A latching device is included for locking the first and second frames in the operating position, the latching device being further operable to cause unlocking of the second frame and for further enabling movement of the second frame into the open position. And, there is a retaining device for the stack of documents when the latching device is unlocked and the second frame is operably moved to the open position. Access to the feed path and the enveloped located within is thereby provided.

BRIEF DESCRIPTION OF THE INVENTION

Figure 1:
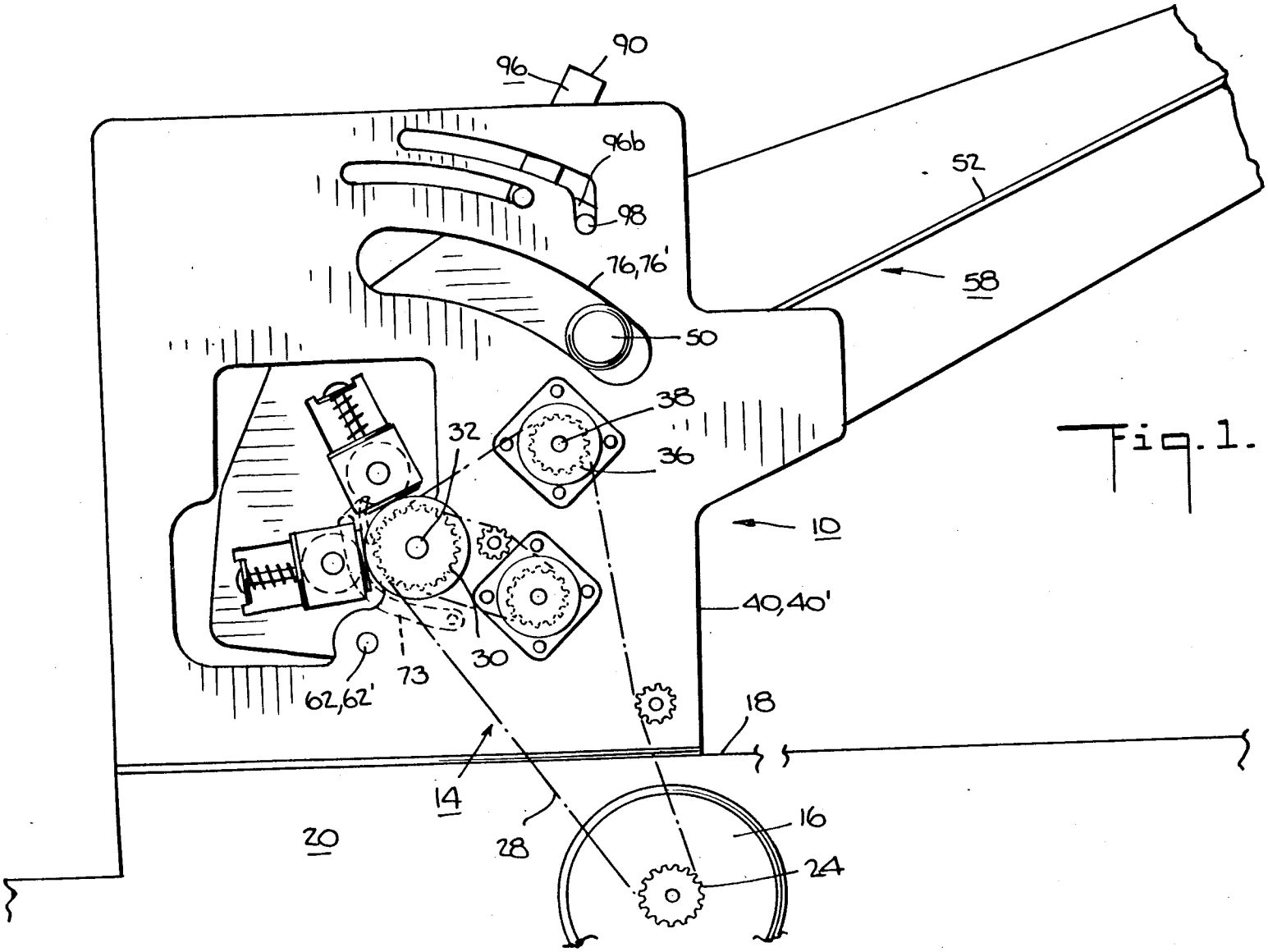
FIG. 1 is a front view of the feeder of the present invention as it is mounted to an inserting machine frame.

Referring to FIG. 1, there is an envelope feeder 10 shown. The present specification will describe the feeder 10 with respect to feeding envelopes, which is but one form of sheet material which may be processed through this feeder 10. There is a drive apparatus 14, including a motor 16, which is suitably secured to a base frame 18 of an inserting machine 20. There is a drive sprocket 24 which engages a pulley 28. The pulley 28 is engaged with a drive sprocket 30 which in turn is suitably secured to a roller 32. The pulley 28 is further connected to a drive member 36, which in turn is connected to a roller 38.

There is a front frame 40, and here it will be noted that there is a corresponding rear frame 40' which in combination with the base frame 18 constitutes the basic structural support for all of the aforementioned components in addition to other cooperating structure to be described hereinbelow.

Figure 2:
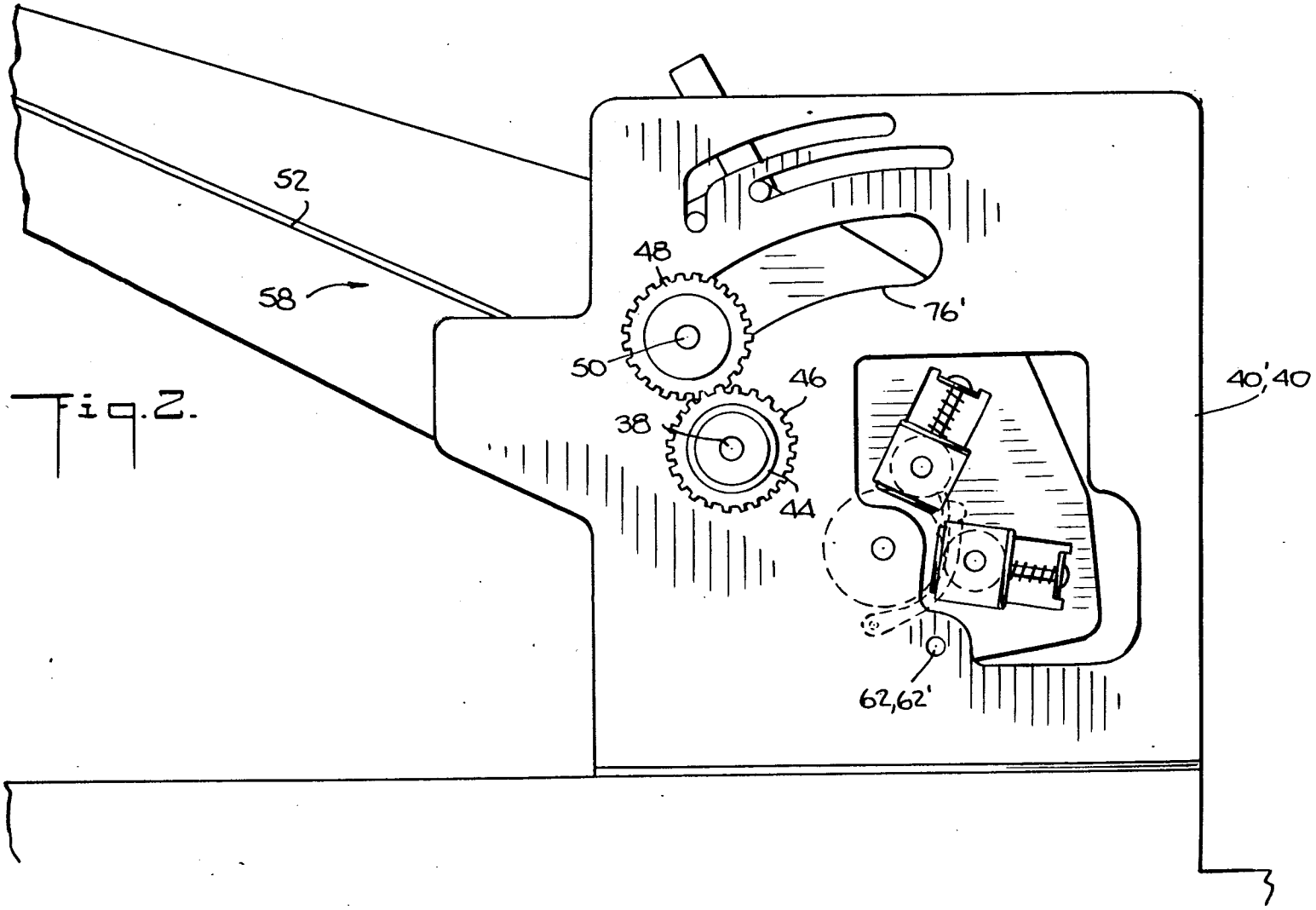
FIG. 2 is a rear view of the same feeder of FIG. 1.

Referring to FIG. 2, the roller 38 is supported by an electro-magnetic clutch-brake assembly 44, which is secured to the rear frame 40'. There is a gear 46 which engages a gear 48 which in turn is firmly secured to a roller 50.

Figure 3:
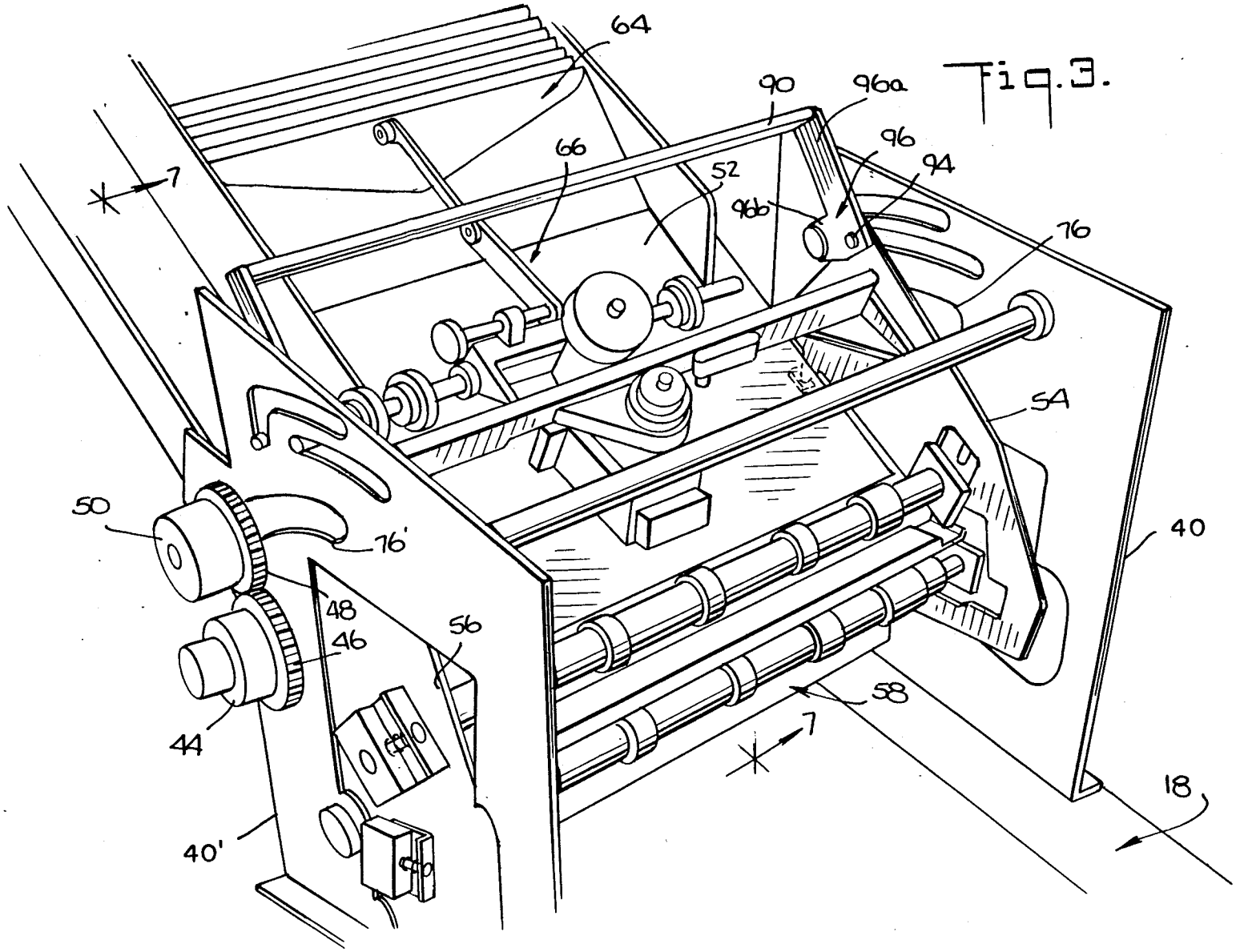
FIG. 3 is an isometric view of the feeder in a closed operating position as viewed from the left, rear side when referring to FIG. 1.
Figure 4:
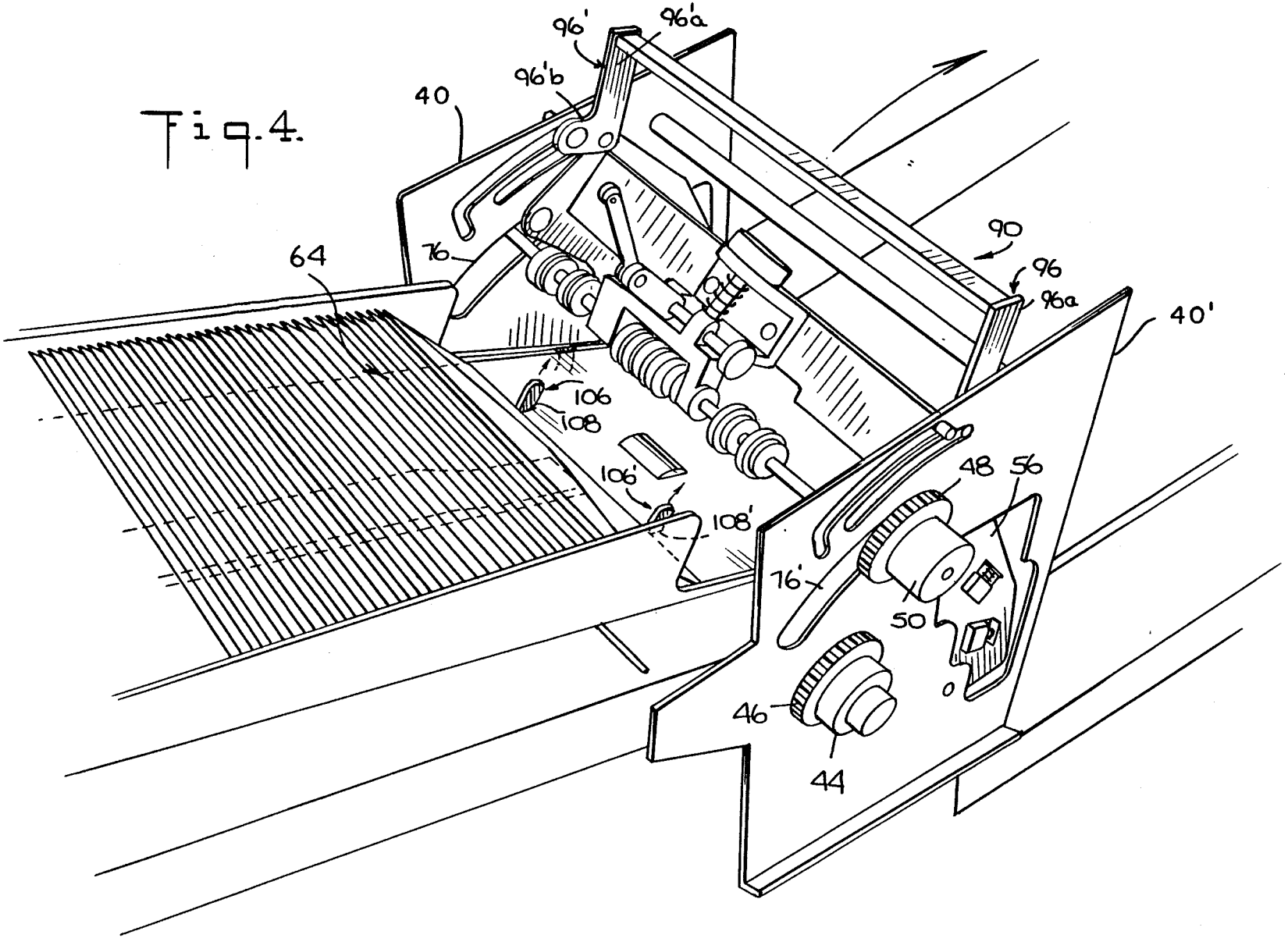
FIG. 4 is an isometric view of the feeder as seen from the right, rear side when referring to FIG. 1; the view showing the second frame raised to the open position to expose the envelope feed path, and the envelope retaining device holding the stacks of envelopes from falling into the lower feed path.
Figure 7:
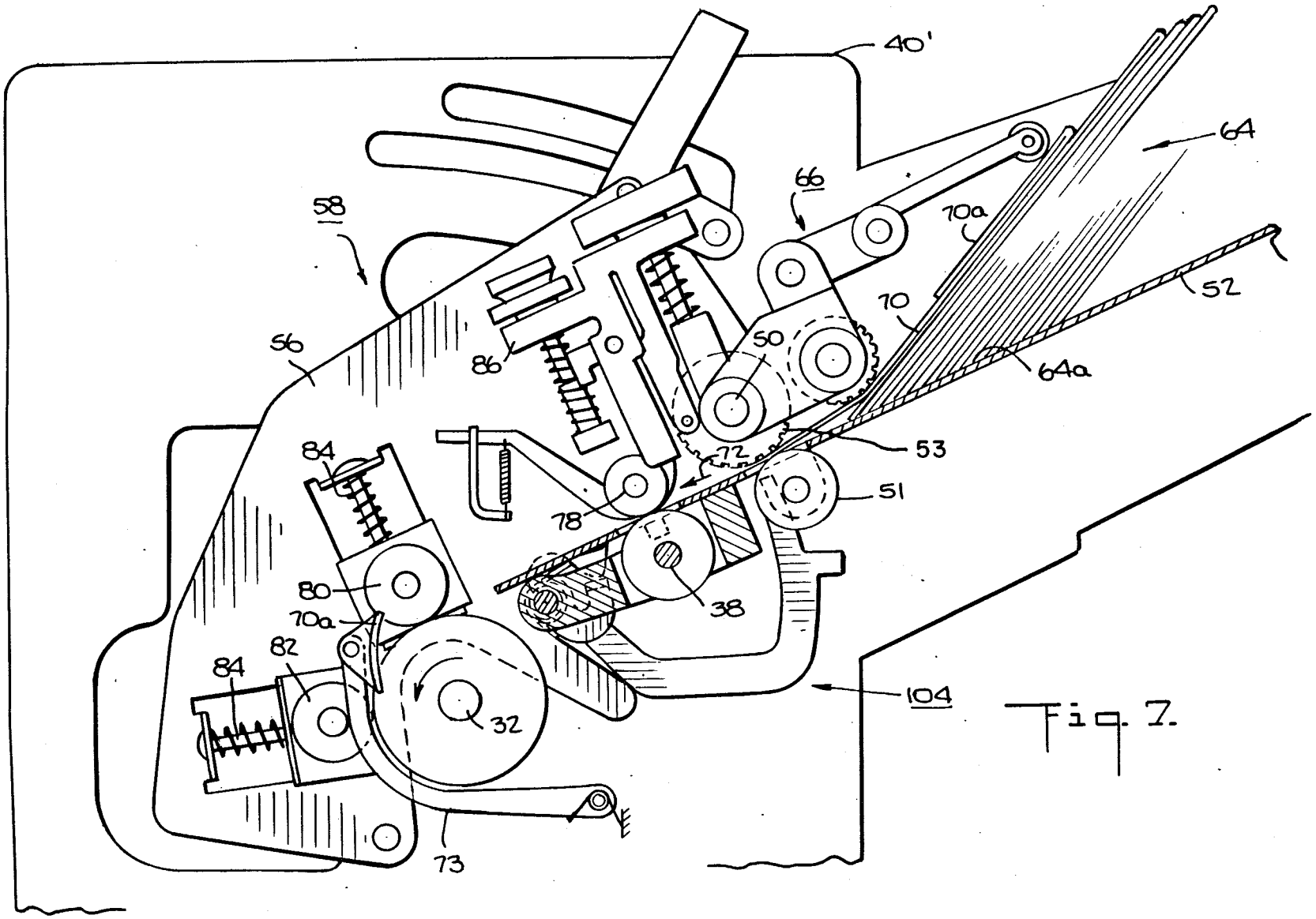
FIG. 7 is a sectional view, enlarged to the same scale as FIG. 5 and taken along the lines of 7—7 from FIG. 3 showing the feeder in the operating position.

Referring to FIG. 3, there is an inclined support surface 52 which is appropriately attached to the front and rear frames 40 and 40'. A front and rear frame 54 and 56 respectively form a second frame assembly 58 which is pivotably mounted on the frames 40 and 40'. (It is noted here that the base frame 18 is the same as the first frame, and will be noted as the first frame from this point on), via a pair of pivot studs 62 and 62' (FIG. 1). A stack of envelopes 64 is seen resting on the inclined support surface 52 such that the envelopes 64 are supported substantially upright, and are fed seriatim from a bottom side **64*a* (FIG. 7) of the stack 64 when the roller 50 is cyclically engaged. There is a stone separator wheel 51 located beneath the deck 52 (FIG. 7). The shaft 50 and attached separator roller 53 causes the desired advance of the envelopes. An envelope support apparatus 66** is provided which is adjustable and used to help make feeder adjustments to compensate for varying types of envelope stock. For the purposes of the present invention, reference may be made to U.S. Pat. No. 2,762,623 issued to F. W. Uthenwoldt et al on Sept. 11, 1956, which contains a full description of the support apparatus 66.

There are a number of apertures and cutouts located in the frames 40 and 40' for permitting various driving instrumentalities of the second frame assembly 58 to operatively link to the drive apparatus 14. The apertures and other apparatus have various functions the details of which will not be discussed at this time. The apertures mentioned above do afford visibility of some of the document moving devices which will now be described in more detail. Referring to FIG. 7 an envelope 70 is shown moving along a feed path 72, and a flap **70*a* is shown in the correct position for being "flapped" open, by a flapping member 73 located at the down stream location of the feed path 72. The operation of the flapping member 73 will not be discussed, but it will suffice to mention that it causes the envelope to be straightened out flat, flap included. This is done so that an insert may be pushed into the opened envelope later in the sequence of events which is not part of the present invention. The roller 50 is journaled in the frames 54 and 56, and reaches through apertures 76 and 76' of the frames 40 and 40' respectively for connective engagement of the gear 48 (FIG. 3). There is a pressure roller assembly 78 (FIG. 7) mounted just downstream of the roller 50 on the frames 54 and 56, for engagement with the roller 38. The rollers 78 and 38 being engaged causes the envelope 70 to move further downstream along the feed path 72. Further downstream, a pressure roller 80 and another pressure roller 82 are mounted in appropriate journals located in the frames 54 and 56. The rollers 80 and 82 are normally engaging the roller 32. There is a compression spring 84 located at lateral ends of each roller 80 and 82, which typically provides bias force to them. There is an adjustable mechanism 86 which is used to provide a biasing force to the roller 38, and all of the rollers as combined provide sufficient drive to enable envelopes of varying thickness to be transported through the feed path 72**.

Normally for feeding operations the second frame assembly 58 is located in the down and operating position shown in FIG. 7. It will be readily evident when referring to FIG. 8, that the feed path 72 is opened when the assembly 58 is raised to an opened position to be described in detail hereinbelow. It will also be noted that the stack of envelopes 64 remains in the position shown in FIG. 8. This is accomplished by a retaining apparatus 104 also to be described hereinbelow. The retaining apparatus 104 holds the stack of envelopes 64 from sliding down into the feed path 72 when the feeder 10 is opened.

Figure 5:
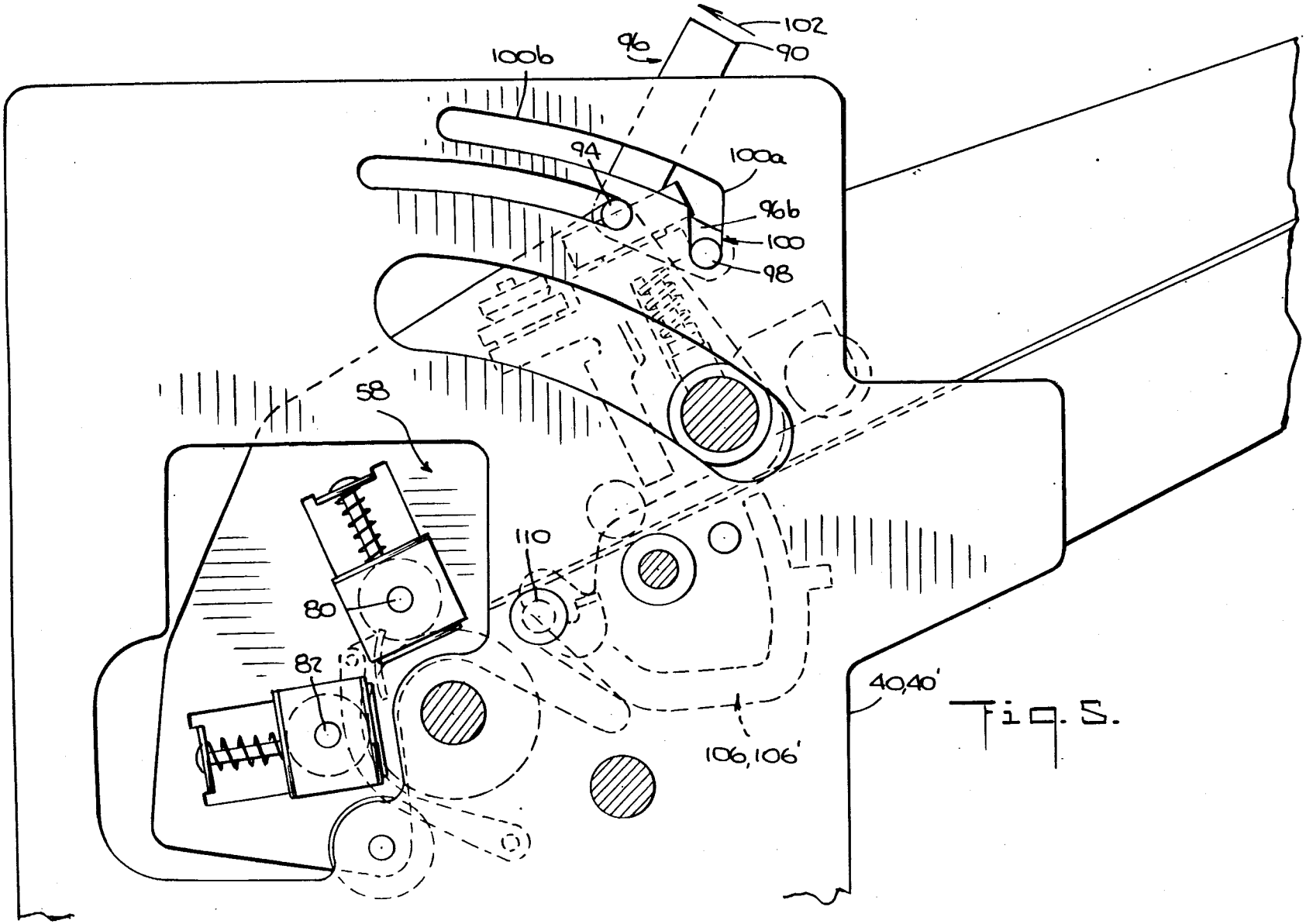
FIG. 5 is a slightly enlarged view of the feeder shown in FIG. 1 with the feeder in the operating position.
Figure 6:
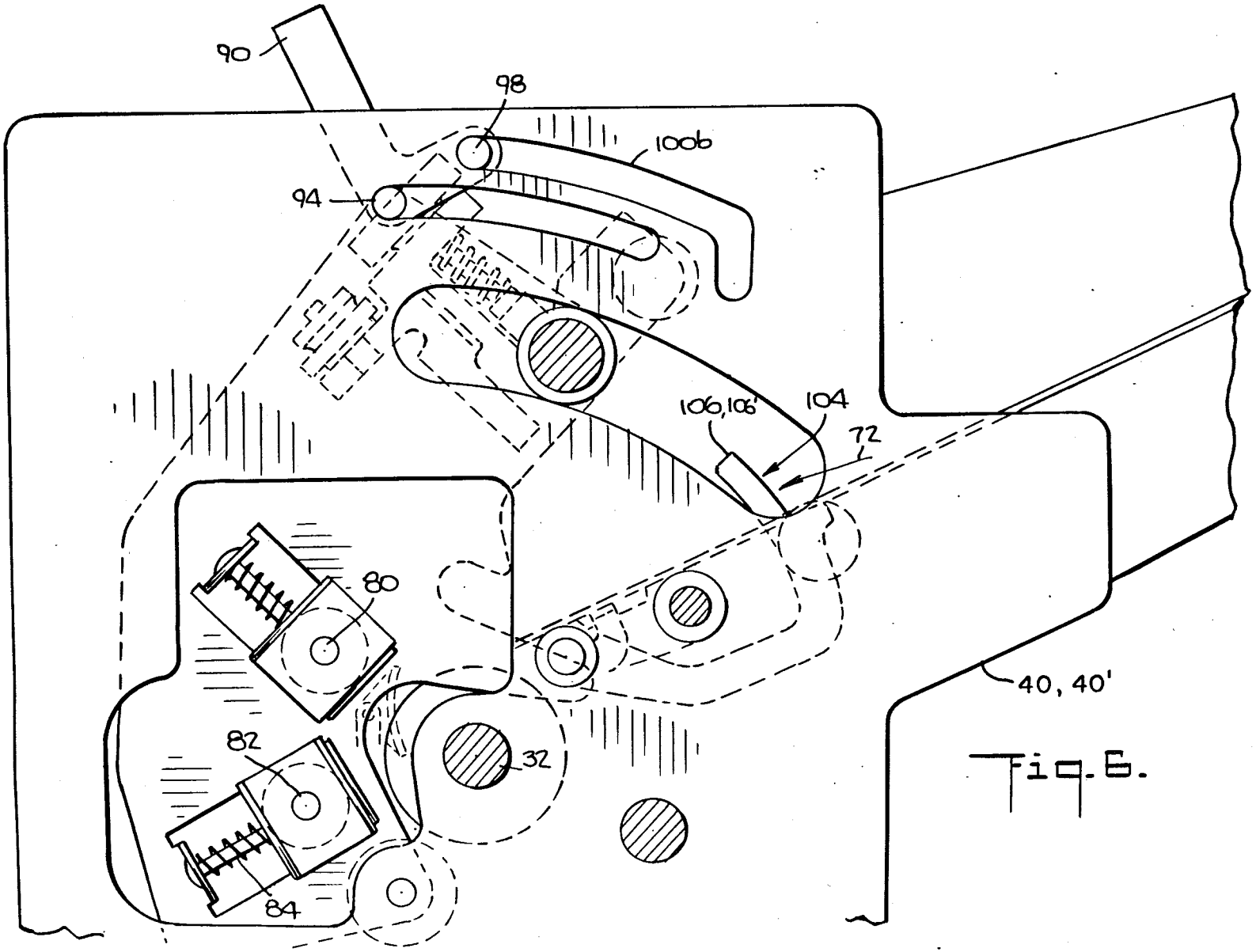
FIG. 6 is a view along the same lines as FIG. 5 with the second frame shown in the open position.
Figure 8:
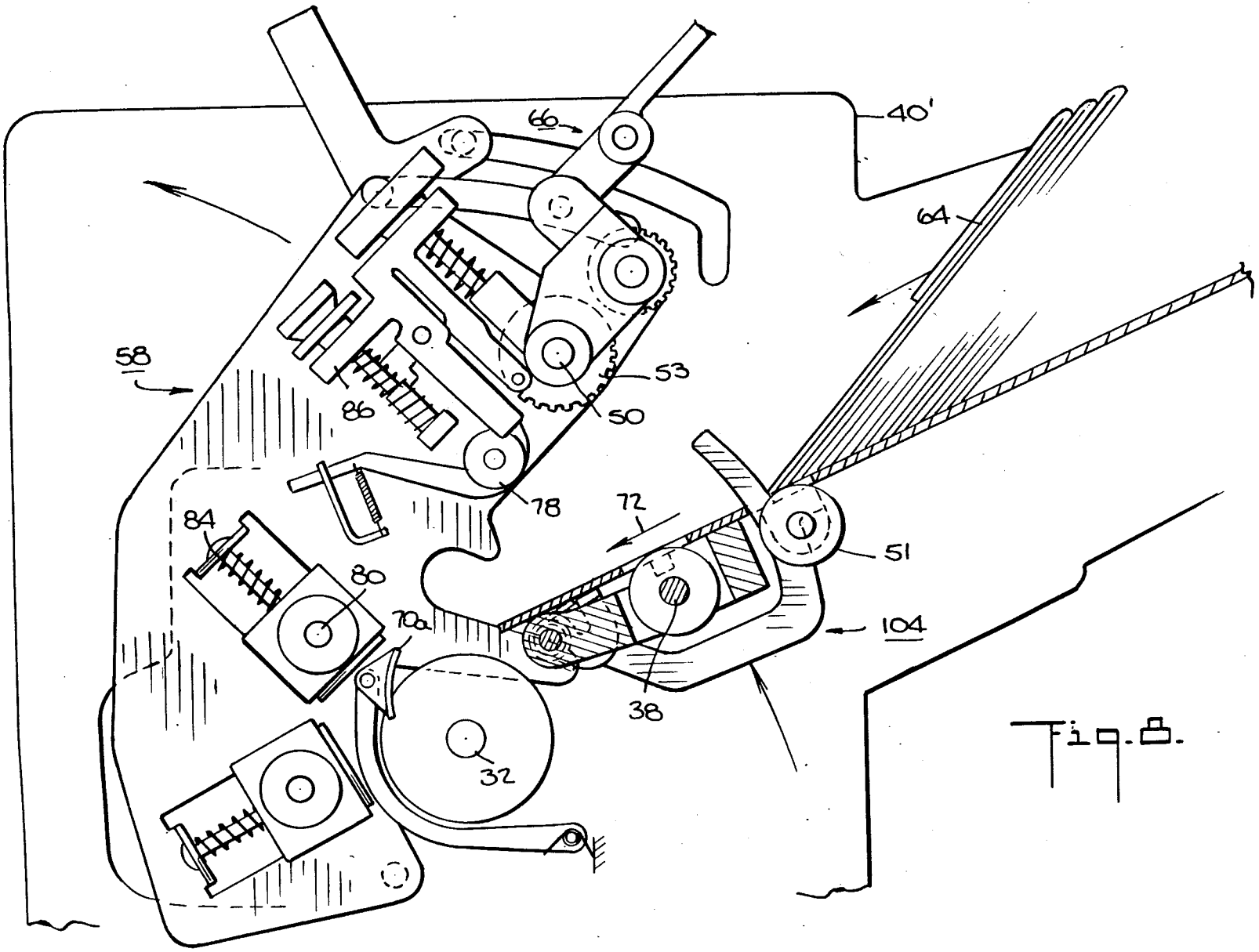
FIG. 8 is a sectional view, enlarged and taken along the same lines (7—7) as FIG. 7, showing the second frame in the open position.
Figure 9:
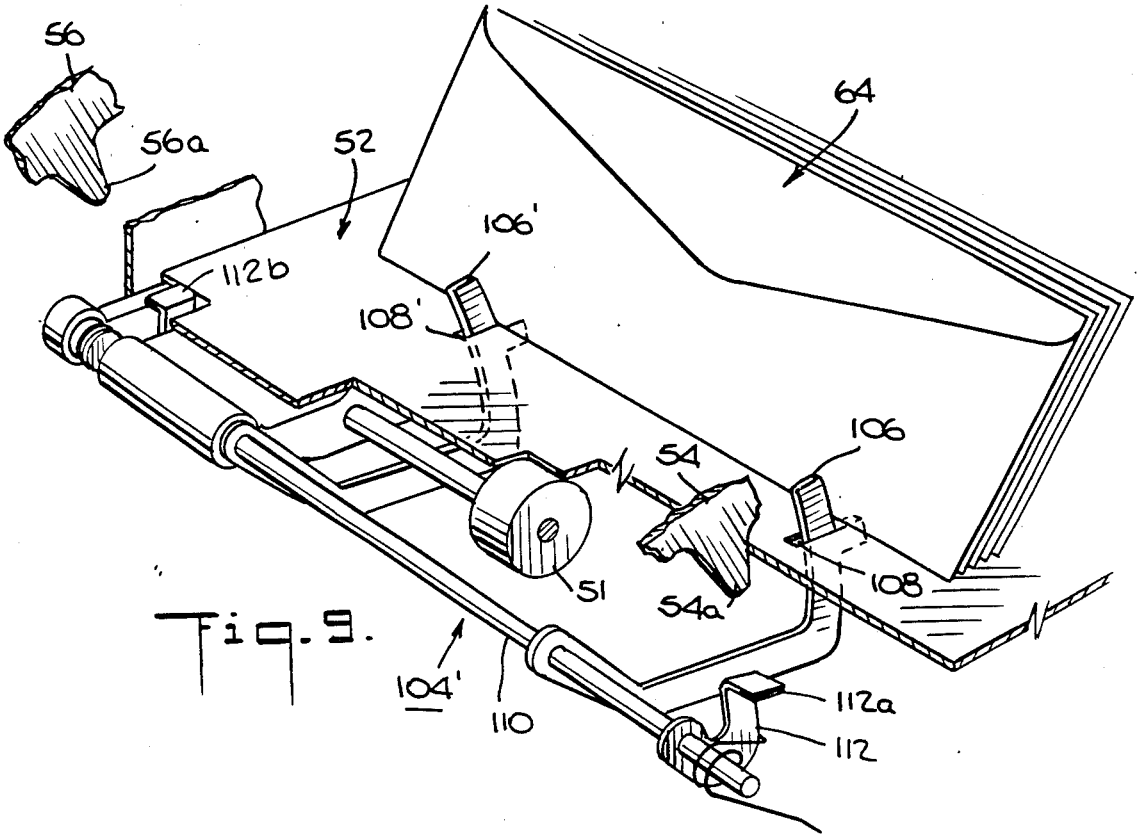
FIG. 9 is a partial isometric view of the envelope supply deck and the envelope retaining apparatus.
Figure 10:
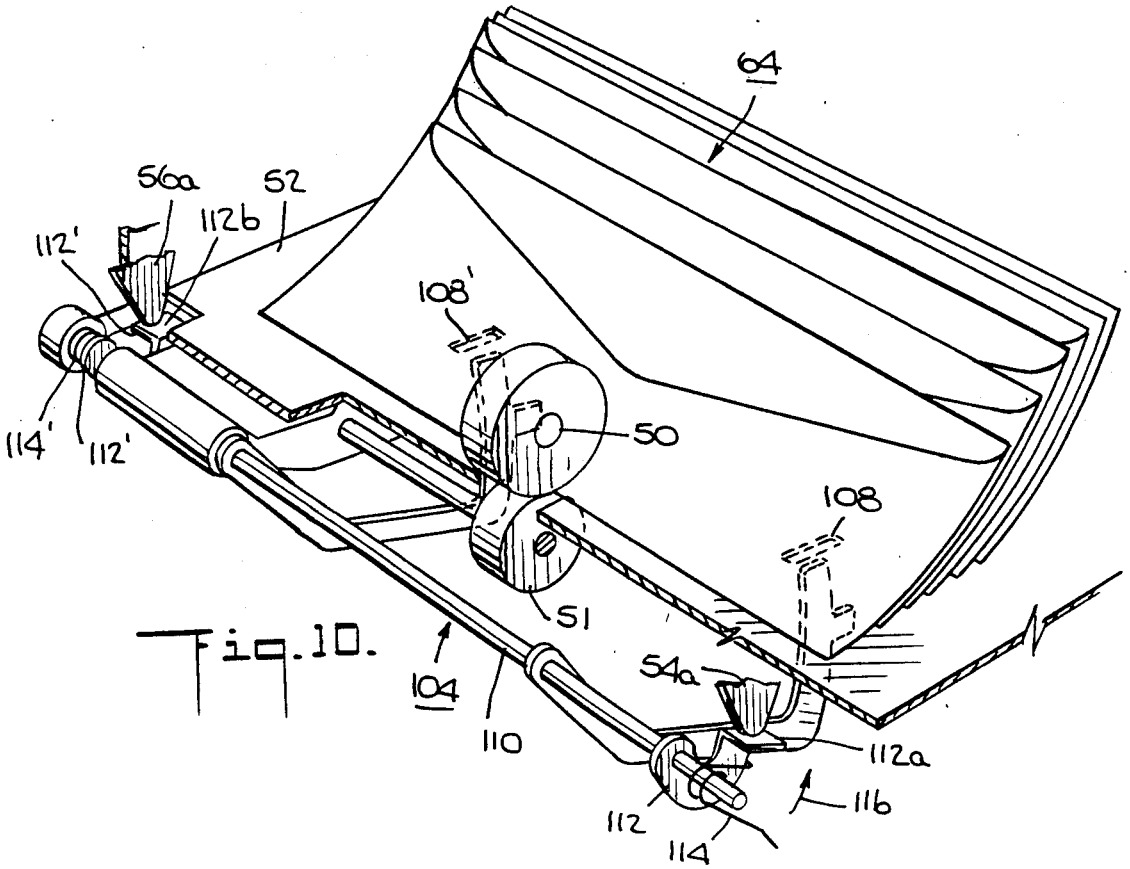
FIG. 10 is a view taken along the same lines as FIG. 9 with the envelope retaining apparatus retracted.

It is likely that it is sometimes necessary for the machine operator to clear a jam. It is possible that, an envelope could jam somewhere along the feed path 72, and it will be evident that when the second frame assembly 58 is raised as shown in FIG. 8, it is relatively easy for an operator to reach into the area of the feed path 72, located between the first frame 18 and the second frame assembly 58 to clear such jams. This is accomplished by the operating connection of the following described parts when an operator grasps the appropriate handle. Referring to FIG. 3, there is a handle 90 which is pivotably attached to the frames 54 and 56 by a connecting pin 94 (only one shown). The handle 90 has a bell shaped arm 96 having one leg **96*a* and a second arm 96*b*. Referring to FIGS. 1, 5 & 6 there is seen the handle 90, the connecting pin 94 and the arm 96 with the arm 96*b*. It will be understood that the handle 90 includes an arm 96' which is the same shape, and performs the same function on the other end of the handle 90 as the arm 96. A pin 98 engages a slot 100 such that as the handle 90 is pivoted in a CCW direction 102, the pin 98 moves CCW about the connecting pin 94 thereby unlocking the handle 90 and enabling the second frame assembly 58 to open and expose the feed path 72 of the feeder 10. It will be noted that the slot 100 has a vertically disposed portion 100*a*, which is commensurate with the closed, locked operating position between the first frame 18 and the second frame assembly 58. An arcuate portion 100*b* of the slot 100 permits rotation of the frame assembly 58 in the CCW direction 102**.

Referring to FIG. 6, the handle 90 is fully retracted, and the feed path 72 is opened. It will be noted that the rollers 80 and 82 are substantially separated from the roller 32, thereby enabling jam clearance of the feed path 72. It will also be noted that there is a retaining apparatus 104 which has been raised into the feed path 72. Referring to FIGS. 5, 6, 7, 8, 9 and 10, a pair of arms 106 and 106' are seen in a substantially upright position, having passed through appropriate apertures 108 and 108' fully engage the bottommost envelopes in the stack 64 and prevent them from falling or sliding down into the feed path 72.

There is a suitable pivot shaft 110 which spans between the frames 40 and 40'. The arms 106, and 106' are suitably keyed to the shaft 110 and rotate together when the shaft 110 is rotated. A tab lever 112, and 112' is located on lateral ends of the shaft 110, and each has a torsion spring 114 and 114' respectively, arranged to give a CCW movement 116 to the apparatus 104. A protuberance **54*a* and 56*a* located on the second frame assembly 58 (frames 54 and 56), normally engages a flat 112*a* and 112*b* of the levers 112 and 112'** respectively.

The protuberances **54*a* and 56*a* normally engage the tabs 112*a* and 112*b* of the levers 112 and 112' respectively when the assembly 58 is in the down, operating position, and therefore the arms 106 and 106' are below the surface 52 which permits the envelopes 70 to move freely through the feed path 72**.

Therefore, having described an envelope and document feeder in detail which is sufficient to enable one skilled in the art to understand how the apparatus of the present invention is applied to keep a stack of articles, envelopes etc. from sliding down into the feed path of the feeder, and further having described a preferred embodiment of the present invention, it will be recognized that the present invention has been described with reference to the drawings enclosed, however, the present invention by no means is liimted to the details set forth, in the accompanying drawings and is intended to cover such modifications or changes as may come within the scope of the appended claims.

What is claimed is:

1. An article feeder for a document processing machine, comprising:

a first stationary frame, a second frame pivotably mounted on said first frame for movement between a closed operating position, and an open position where operator access to said documents is provided, an inclined surface mounted on said first frame for supporting a stack of documents in a substantially upright position, said stack of documents being fed seriatim from a lower end of said stack, separator means mounted on said first and second frames including drive means for cyclically feeding said documents seriatim from said lower end of the said stack, said separator means being supported on said first and second frames at an upstream location within a separable feed path for advancing and conveying said documents when said first and second frames are in said closed, operating position, feeding means mounted along said feed path for conveying said documents, said feeding means, including said separator means so that both said feeding and separating means are separable and exposed when said first and second frame is moved to said open position, latching means for locking said first and second frames into said operating position, said latching means being further operable to cause unlocking of said second frame and for further enabling movement of said second frame into said open position, and means for retaining said stack of documents when said latching means is unlocked and said second frame is operably moved to said open position thereby providing access to said documents located within said feed path when said feed path is exposed.

2. A feeder as set forth in claim 1 wherein said separator means includes:

a separator stone mounted on said first frame, and a roller including an operable clutch mounted on said second frame for causing cyclical engagement of said roller with said lower end of said stack of documents thereby causing feeding of said documents seriatim.

3. A feeder as set forth in claim 1 wherein said feeding means includes:

a first train of rollers, connected to said drive means said roller being and rotatably supported in said first frame for conveying said documents, and a second train of rollers, each of which is resiliently biased towards said first rollers when said first and second frames are in said operating position for engaging and conveying said documents.

4. A feeder as set forth in claim 1 wherein said latching means includes:

a lever arm asesmbly pivotably secured to said second frame and having at least one engagement pin adapted to an arcuate shaped slot in said first frame, said arcuate slot being further oriented so as to maintain said arm assembly in a locked position which is commensurate with said closed operating position of said first and second frames and being further oriented so as to assist in unlocking said first and second frames when said arm assembly is pivoted in a direction whereby said engagement pin traverses said arcuate slot away from said locked position.

5. A feeder as set forth in claim 1 wherein said retaining means includes:

a retaining apparatus, mounted on a shaft, said apparatus including a plurality of arms, including a first pair of arms for operably engaging said lower end of said stack of documents when said latching means is moved to cause said first frame to raise to said open position, said retaining apparatus being normally resiliently biased to move said first pair of arms through a pair of apertures located in said inclined surface thereby intercepting said feed path, said apparatus further including a pair of cams mounted on said second frame for normally engaging a second pair of arms of said plurality of arms for maintaining said first pair of arms in a position substantially below said feed path, thereby permitting said documents to be fed therethrough when said second frame is in said closed, operating position.

* * * * *